US009682852B2

(12) United States Patent
Knöpfel

(10) Patent No.: US 9,682,852 B2
(45) Date of Patent: Jun. 20, 2017

(54) APPARATUS FOR FORMING A TUBE OF POCKET MATERIAL AND METHOD FOR MANUFACTURING A POCKET SPRING STRING

(75) Inventor: Hans Knöpfel, Arbon (CH)

(73) Assignee: Spuhl AG, Wittenbach (CH)

( * ) Notice: Subject to any disclaimer, the term of this patent is extended or adjusted under 35 U.S.C. 154(b) by 651 days.

(21) Appl. No.: 14/342,009

(22) PCT Filed: Aug. 2, 2012

(86) PCT No.: PCT/EP2012/003306

§ 371 (c)(1),
(2), (4) Date: May 12, 2014

(87) PCT Pub. No.: WO2013/029736

PCT Pub. Date: Mar. 7, 2013

(65) Prior Publication Data

US 2014/0318081 A1 Oct. 30, 2014

(30) Foreign Application Priority Data

Aug. 30, 2011 (EP) ..... 11007049

(51) Int. Cl.
*B68G 9/00* (2006.01)

(52) U.S. Cl.
CPC ..... *B68G 9/00* (2013.01)

(58) Field of Classification Search
CPC ..... B68G 9/00; A47C 27/064; A47C 27/063; A47C 27/06; B65B 9/20; B65B 9/2021; B65B 9/22
USPC ..... 53/438, 439, 450, 114, 529, 530, 550; 493/302, 243, 248
See application file for complete search history.

(56) References Cited

U.S. PATENT DOCUMENTS 229,479 A * 6/1880 Scholfield ..... B65H 45/107 493/406
466,023 A * 12/1891 Sutton ..... B65H 45/22 493/439
1,574,789 A * 3/1926 Burgess ..... B31D 1/00 493/355
1,618,711 A * 2/1927 Hunt ..... B65H 45/22 206/494
1,710,979 A * 4/1929 Herbener ..... B68G 7/04 100/232

(Continued)

FOREIGN PATENT DOCUMENTS

CA WO 9418116 A1 * 8/1994 ..... B68G 9/00
CH WO 9852867 A1 * 11/1998 ..... B68G 9/00

(Continued)

*Primary Examiner* — Hemant M Desai
*Assistant Examiner* — Lucas Palmer
(74) *Attorney, Agent, or Firm* — Wood, Herron & Evans, LLP

(57) ABSTRACT

An apparatus for forming a tube (54) of pocket material (22) for manufacturing a pocket spring string includes a cartridge (30) for guiding the pocket material (22). The cartridge (30) has at least one first element (61) and at least one second element (62). A relative position between the at least one first element (61) and the at least one second element (62) may be set in a direction (60) perpendicular to an axis (50) of the cartridge (30), in order to adjust a spacing between sides of the cartridge (30).

15 Claims, 9 Drawing Sheets

(56) References Cited

U.S. PATENT DOCUMENTS 3,111,310 A * 11/1963 Dutro ..... B65H 45/09 493/439
3,296,770 A * 1/1967 Wilson ..... B65B 9/2035 493/248
3,415,171 A * 12/1968 Wilson ..... B65B 9/22 493/302
3,431,828 A * 3/1969 Crawford ..... B65H 29/46 198/597
3,449,190 A * 6/1969 Bronstien, Jr. ..... B21F 33/04 156/250
3,668,816 A * 6/1972 Thompson ..... B65B 9/093 29/91.1
4,194,438 A * 3/1980 Schmachtel ..... B65B 9/2028 493/274
4,439,977 A * 4/1984 Stumpf ..... A47C 27/064 156/200
4,494,362 A * 1/1985 Koch ..... B65B 9/06 493/302
4,766,716 A * 8/1988 Dominguez ..... B65B 9/2028 226/174
4,854,023 A * 8/1989 Stumpf ..... B68G 9/00 156/70
4,986,518 A * 1/1991 Stumpf ..... B68G 9/00 267/89
5,255,495 A * 10/1993 Kovacs ..... B65B 9/067 53/504
5,408,806 A * 4/1995 Lin ..... B65B 9/06 493/476
5,509,887 A * 4/1996 Smith ..... A47C 27/063 493/439
5,553,443 A * 9/1996 St. Clair ..... B68G 9/00 53/438
5,572,853 A 11/1996 St. Clair et al.
5,799,467 A * 9/1998 Nankervis ..... B65B 9/06 53/261
6,101,697 A * 8/2000 Stumpf ..... B68G 9/00 29/771
6,175,997 B1 * 1/2001 Mossbeck ..... A47C 27/064 156/301
6,315,275 B1 * 11/2001 Zysman ..... B68G 9/00 267/89
6,336,305 B1 * 1/2002 Graf ..... B68G 9/00 53/114
6,374,442 B1 * 4/2002 Wells ..... A47C 27/063 5/655.8
6,499,275 B1 * 12/2002 Graf ..... B65B 9/073 5/720
6,622,384 B1 * 9/2003 Spinks ..... B21F 35/04 29/896.92
7,003,929 B2 * 2/2006 Laplace ..... B65B 9/22 493/302
7,356,978 B2 * 4/2008 Dall'Omo ..... B65B 25/143 53/450
7,426,810 B2 * 9/2008 Takahashi ..... A47C 23/0433 53/114
8,402,642 B2 * 3/2013 Kujuro ..... B68G 9/00 156/264
8,567,163 B2 * 10/2013 Præstholm ..... B30B 9/3014 53/257
9,139,318 B2 * 9/2015 Lee ..... B65B 5/04
2001/0042360 A1 * 11/2001 Santis ..... B68G 9/00 53/436
2002/0026770 A1 * 3/2002 Gibbons ..... B68G 9/00 53/114
2004/0103618 A1 * 6/2004 De Santis ..... B68G 9/00 53/438
2007/0022532 A1 * 2/2007 Ahn ..... A47C 27/04 5/430
2013/0097976 A1 * 4/2013 Honegger ..... B65B 59/02 53/492

FOREIGN PATENT DOCUMENTS

DE 624410 1/1936
DE 624410 C * 1/1936 ..... B68G 9/00
FR 1355409 A * 3/1964 ..... A47C 27/0453
FR 1475098 A * 3/1967 ..... B68G 9/00
GB 1022287 A * 3/1966 ..... B68G 9/00
GB WO 2007031774 A1 * 3/2007 ..... B68G 9/00
IT EP 1652771 A1 * 5/2006 ..... B65B 9/06
JP 04266443 A * 9/1992 ..... A47C 27/063
WO WO 9640557 A1 * 12/1996 ..... B68G 9/00
WO WO 0063113 A1 * 10/2000 ..... B68G 9/00

* cited by examiner

APPARATUS FOR FORMING A TUBE OF POCKET MATERIAL AND METHOD FOR MANUFACTURING A POCKET SPRING STRING

The invention relates to an apparatus for forming a tube of pocket material for manufacturing a pocket spring string and to a method for manufacturing a pocket spring string. In particular, the invention relates to an apparatus and a method of this kind which can be used with a machine for manufacturing a pocket spring string or an automated device for manufacturing a pocket spring core in order to insert springs into pockets.

For manufacturing pocket spring cores, there are used machines or automated device with which a high degree of automation is attainable when manufacturing pocket spring strings and pocket spring cores. Machines or automated device of this kind can include a spring shaper for manufacturing springs and a processing station for inserting springs into pockets. Further stations, in which the springs are for example selectively turned and/or pocket spring strings may be joined together to form a pocket spring core, may be placed downstream of the spring shaper. The number and mode of functioning of the stations downstream of the spring shaper may differ in dependence on the mode of functioning of the respective machine or automated device.

The station for inserting springs into pockets may be a cartridge with the aid of which a tube of pocket material is formed. Springs are put into the tube. The cartridge is conventionally constructed to have fixed dimensions and may be shaped as a one-piece body. The internal dimensions of the cartridge are matched to properties of the springs and/or the pocket material. Examples of conventional stations of this kind for inserting springs into pockets are described in U.S. Pat. No. 4,986,518, U.S. Pat. No. 5,553,443 and U.S. Pat. No. 5,572,853.

In the case of conventional stations for inserting springs into pockets, the use of the cartridge may entail restrictions inasmuch as they only permit relatively small variations in the height of springs to be inserted into pockets, the set value of the pretension of springs, the diameter of springs to be inserted into pockets or the width of the pocket material. This restricts the usability of the station for different spring heights, spring pretensions, spring diameters or widths of the pocket material.

In order to improve usability of the station for inserting springs into pockets for different spring heights, spring pretensions, spring diameters or widths of the pocket material, the cartridge may be constructed as an exchangeable part. A set of different cartridges may be used in order to meet the demands of relatively large variations in spring heights, spring pretensions, spring diameters or widths of the pocket material. However, exchanging the cartridge device a burden of work. Operation of the station for inserting springs into pockets must be interrupted until the cartridge has been replaced.

There is a need for an improved apparatus for forming a tube of pocket material and an improved method for manufacturing a pocket spring string. In particular, there is a need for an apparatus and a method of this kind which enable adaptation to different parameters in a relatively simple manner. For example, there is a need for an apparatus and a method of this kind which enable a station for inserting springs into pockets to be made usable for different spring heights and/or different spring pretensions and/or different spring diameters and/or different widths of the pocket material.

According to the invention, an apparatus and a method are specified as defined in the independent claims. The dependent claims define exemplary embodiments.

According to an embodiment of the invention, an apparatus for forming a tube of pocket material is specified. The apparatus includes a cartridge for guiding the pocket material. The cartridge includes at least one first element and at least one second element. The cartridge has an axis, a first side defined by the at least one first element and a second side defined by the at least one second element, wherein the first side and the second side are arranged spaced from one another. The apparatus includes an adjustment mechanism which is coupled to the cartridge and set up to alter a relative position between the at least one first element and the at least one second element in a direction perpendicular to the axis, in order to adjust a spacing between the first side and the second side.

The apparatus enables the internal dimension of the cartridge to be set. The cartridge may be adapted to different spring heights, spring pretensions or widths of the pocket material by adjusting a spacing between the first side and the second side and hence a width of the cartridge perpendicular to the axis of the cartridge. The cartridge may also allow an alteration in the height of the cartridge in order to allow different spring diameters or widths of the pocket material to be adjusted.

The apparatus may be set up to guide the pocket material through on an inner side of the cartridge. The pocket material may be guided by the apparatus such that it abuts against inner sides of the cartridge. The apparatus may be set up to guide through, on the inner side of the cartridge, springs to be inserted into the pockets. In this way, the springs may be put into the tube of pocket material inside the cartridge.

The apparatus may be set up to form a rectangular tube of pocket material.

The apparatus may include a device for turning around the pocket material, which is arranged at an end of the cartridge. This device for turning around the pocket material is able to fold the pocket material around in the entry region of the cartridge, forming a tube shape which is guided through on the inner side of the cartridge.

The device for turning around the pocket material may include at least one projection, which protrudes from the at least one first element or the at least one second element, and a folding element having a cavity, wherein the at least one projection projects into the cavity of the folding element. Using a separate folding element enables simple adaptability to different settings of the cartridge.

An edge of the at least one projection and an edge of the folding element may extend along a common straight line or parallel to one another. This allows the folding element to be displaced along the at least one projection when the spacing between the first side and the second side of the cartridge is adjusted.

A cross-sectional surface of the cavity of the folding element may take the form of an isosceles triangle. A base surface of the folding element may take the shape of an isosceles triangle. This has the effect that the device for turning the pocket material around may be adapted in a simple manner to different settings of the cartridge.

The at least one first projection may include a first projection which protrudes from the at least one first element and a second projection which protrudes from the at least one second element. Both the first projection and the second projection may project into the cavity of the folding element. The first projection may be triangular. The second projection may be triangular. A plane in which there lie the first projection and the second projection may be inclined in relation to the axis of the cartridge. As a result of a construction of this kind, the device for turning around the pocket material may be adapted in a particularly simple manner to different settings of the cartridge.

The at least one first element may have a plurality of projections which project into a plurality of corresponding recesses. The projections may extend in a direction perpendicular to the axis of the cartridge. The corresponding recesses may be provided in the at least one second element. The corresponding recesses may also be provided in a further element of the cartridge in relation to which the at least one first element is adjustably mounted. By using projections of this kind, it is possible to prevent an elongate gap extending parallel to the axis over the length of the cartridge from being formed in undesirable manner when the cartridge is adjusted.

The cartridge may include at least one third element lying in a plane perpendicular to the first side and the second side. The at least one third element may at least partly cover the at least one first element and the at least one second element. This makes it possible to prevent an elongate gap extending parallel to the axis over the length of the cartridge from being formed when the cartridge is adjusted.

The first side and the second side may be opposing inner sides of the cartridge which extend parallel to the axis.

The cartridge may have a rectangular cross section with mutually perpendicular sides. This enables the rectangular tube of the pocket material to be formed. Corners of the cross section may be rounded at least on the inside of the cartridge.

The at least one first element may include a first pair of elements whereof the relative position is adjustable in a further direction perpendicular to the axis, wherein the further direction is perpendicular to the axis and to the direction. The at least one second element may include a second pair of elements whereof the relative position is adjustable in the further direction perpendicular to the axis. This makes it possible to perform an adjustment both to different spring heights and to different spring diameters.

The apparatus may include a heat-sealing device for making a heat-sealed seam that extends perpendicular to the axis. The heat-sealing device is mounted such that it is movable relative to the cartridge along a path of motion extending along the axis. The path of motion of the heat-sealing device extends at an angle other than 90° relative to the axis of the cartridge. The path of motion of the heat-sealing device may in particular extend parallel to the axis of the cartridge. This allows the heat-sealing device for making a transverse seam also to be used for moving on the pocket material.

The apparatus may include a further heat-sealing device for making a heat-sealed seam that extends along a longitudinal direction of the pocket material. The further heat-sealing device may be arranged to make the longitudinal heat-sealed line while the pocket material is guided through the cartridge. The cartridge may have a recess through which ends of the pocket material project outwards to allow the longitudinal heat-sealed line to be made.

The apparatus may include a feed device for feeding the pocket material. This may include a drive device for driving a roll of the pocket material.

The adjustment mechanism may be actuable manually. It is also possible to provide a drive device for driving the adjustment mechanism.

The adjustment mechanism may be set up to move both the at least one first element and the at least one second element relative to a holder. This makes symmetrical adjustment possible. The adjustment mechanism may also be set up to move only the at least one first element or to move only the at least one second element. This allows the construction of the adjustment mechanism to be simpler.

The adjustment mechanism may include a guide for the at least one first element and/or the at least one second element. The guide may extend perpendicular to the axis of the cartridge.

The adjustment mechanism may include a spindle drive in order to move the at least one first element and/or the at least one second element.

The adjustment mechanism may be set up to lock a relative position between the at least one first element and the at least one second element once a desired setting of the relative position has been reached.

According to a further embodiment of the invention, a machine for manufacturing a pocket spring string is specified. The machine includes an apparatus for forming a tube of pocket material according to an embodiment or an exemplary embodiment and a device for feeding springs to a cavity defined by the cartridge.

The machine may furthermore include a spring shaper.

According to a further embodiment of the invention, a machine for manufacturing a pocket spring core is specified. The machine includes a spring shaper for shaping springs, an apparatus for forming a tube of pocket material according to an embodiment or an exemplary embodiment, a device for transferring the springs from the spring shaper to a cavity defined by the cartridge, and a device for joining together a plurality of pocket spring strings of finite length into a pocket spring core.

According to a further embodiment of the invention, a method for manufacturing a pocket spring string is specified. Using a cartridge which includes at least one first element and at least one second element, a tube of pocket material is formed and springs are inserted therein. A relative position between the at least one first element and the at least one second element is set in a direction perpendicular to an axis of the cartridge in order to set an internal dimension of the cartridge.

The method allows an internal dimension of the cartridge to be set. The cartridge may be adapted to different spring heights, spring diameters, spring pretensions or widths of the pocket material.

The relative position may be set as a function of a height of the springs, that is to say to the spring dimension along the axial direction of the springs.

The relative position may be set as a function of a spring diameter of the springs.

The relative position may be set as a function of a set value of the pretension of the springs.

The relative position may be set as a function of a width of a web of the pocket material.

The method may be carried out using the apparatus for forming a tube of pocket material according to an embodiment or an exemplary embodiment.

The apparatuses, machine and methods according to exemplary embodiments may be used for inserting springs into the pockets. The springs may be helical springs.

The springs may be cylindrical helical springs. The springs may have a diameter that varies along the spring axis. The springs may be helical barrel springs. The springs may be conical springs, double-conical springs or hourglass-shaped springs.

Exemplary embodiments of the invention will be explained in more detail with reference to the attached drawing.

Figure 1:
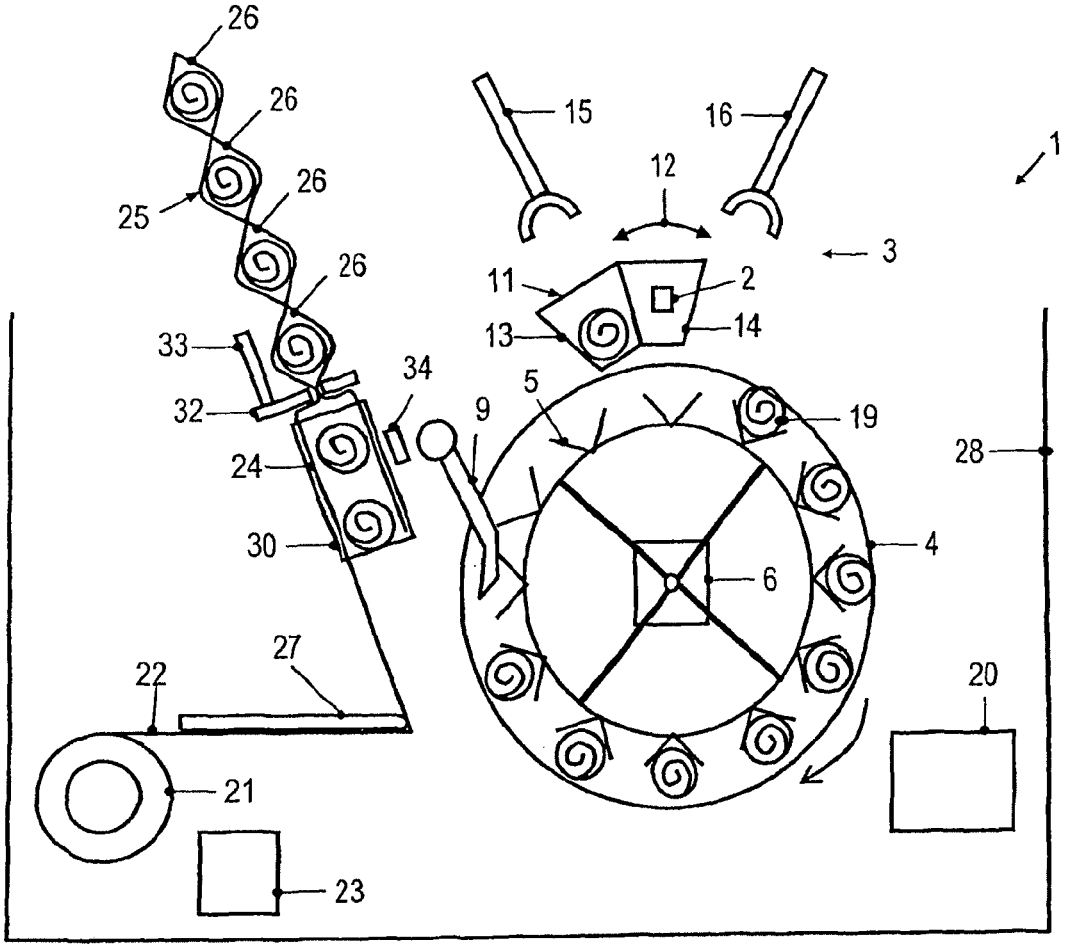
FIG. 1 is a schematic illustration of a machine for manufacturing a pocket spring string according to an exemplary embodiment.

Exemplary embodiments of the invention will be explained in more detail below. The features of the different exemplary embodiments may be combined with one another, unless this is explicitly ruled out in the description below. Even though individual exemplary embodiments are described in relation to specific applications, for example in the context of a machine for manufacturing a pocket spring core, the present invention is not restricted to these applications. Similar or identical reference numerals relate to similar or identical elements.

According to exemplary embodiments, an apparatus for forming a tube of pocket material and a corresponding method are specified in which a cartridge for forming the tube of pocket material is adjustable. The cartridge has a plurality of elements which are adjustable in relation to one another to alter a width and/or height of the cartridge perpendicular to a longitudinal axis of the cartridge. The setting for the cartridge used in each case for manufacturing a pocket spring string may be selected as a function of a spring height or a desired pretension of the springs or a spring diameter of the springs to be inserted into the pockets. The setting for the cartridge used in each case for manufacturing a pocket spring string may as an alternative or in addition also be selected as a function of a width of a web of pocket material in which the springs are to be enclosed.

The apparatus for forming the tube of pocket material may be used in a machine for manufacturing a pocket spring string, as described with reference to FIG. 1, or in a machine for manufacturing a pocket spring core, as described with reference to FIG. 2.

FIG. 1 is a schematic illustration of a machine 1 for manufacturing a pocket spring string according to an exemplary embodiment. The machine 1 includes a spring winding device having a winding head 2, a device 3 for transferring the springs from the winding head 2 to a spring conveyor, a spring conveyor that takes the form of a transport wheel 4 and has a drive 6, and a station for inserting the springs into pockets, which are mounted on a frame 28 of the machine. During operation of the machine 1, springs shaped by the winding head 2 are transferred from the device 3 to the transport wheel 4. The transport wheel 4 has a plurality of receivers 5, each of which can receive a spring 19. The drive 6 drives the transport wheel 4, wherein the springs cool during transport from the winding head 2 before they are inserted into the pockets. The transport wheel 4 acts as a cooling wheel. With this arrangement, it is possible for example for the wire to be heated before the springs are shaped, or a heat treatment may be carried out on the shaped springs.

The device 3 for transferring the springs may have a transfer device 11 having a plurality of chamber-like sections 13, 14 in each of which the transfer device 11 can receive a spring. The transfer device 11 may be mounted in movable manner, with the result that it can be moved between a first and a second position, as illustrated schematically by the arrow 12. In the first position, the transfer device 11 is arranged such that the first section 13 receives a spring shaped by the winding head 2. In the second position, the transfer device 11 is arranged such that the second section 14 receives a spring shaped by the winding head 2. The device 3 for transferring the springs includes two sliders 15, 16 which are movable linearly and transfer the springs from one of the chamber-like sections 13, 14 to the transport wheel 4. With this arrangement, one of the sliders 15, 16 reaches into the one of the sections 13, 14 in which no spring is currently being shaped.

Other embodiments of the processing stations may be used, arranged upstream of inserting springs into the pockets. For example, the device 3 for transferring the springs may have simpler constructions, in which the springs are transferred by a combination of a pivotal element and a slider.

The springs 19 are ejected from the transport wheel 4 by a further transfer device 9, for example one or more pivot levers. The springs are transferred to an apparatus which forms a tube of pocket material inside which the springs are encapsulated. The result is that a pocket spring string 25 having a plurality of springs 26 inserted into pockets is formed. The term pocket spring string 25 is generally used to designate a plurality of pockets which are connected to one another and have springs inserted therein.

The apparatus for forming the tube of pocket material, which will be described in more detail below, has an adjustable cartridge 30 and an adjustment mechanism which is used to adjust the cartridge 30 as a function of a spring dimension, a set value for the spring pretension or properties of the pocket material.

The pocket material 22 is unwound from a roll 21. A drive 23 can drive the roll 21 of pocket material. The drive 23 may be controlled such that the material required to insert the springs into pockets is actively unwound from the roll 21.

The pocket material is pre-folded by a device 27. For example, the web of pocket material 22 may be pre-folded such that the web is folded centrally. The side of the web of pocket material which becomes the inside of the tube may be arranged on the outside of the pre-folded web. The device 27 may include a plurality of triangular elements to pre-fold the web of pocket material appropriately.

The pre-folded web is folded around in an entry region of the cartridge 30 to form an initially still open tube 24 which is guided through a cavity defined by the cartridge 30. Other embodiments are possible to fold the web of pocket material into a tube inside which the springs are encapsulated.

The pocket material may be activated by heat to make it possible to heat-seal the tube of pocket material. The pocket material may for example be a nonwoven material.

To encapsulate the springs, the pocket material may be heat-sealed. For the purpose of making transverse heat-sealed seams, a heat-sealing device 32 which is arranged downstream of the cartridge 30 may be provided. For the purpose of making a longitudinal heat-sealed seam, a further heat-sealing device 34 may be provided. The further heat-sealing device 34 may make the longitudinal seam while the tube 24 of pocket material and the springs are being guided through the cartridge 30. For the purpose of producing the longitudinal seam, the longitudinal edges of the pocket material may project out of the cartridge 30 through a gap.

For the purpose of transporting the pocket material and the springs inserted therein, a separate transport device may be provided. As an alternative or in addition, in an exit region of the cartridge 30 the pocket spring string 25 may also be transported through the heat-sealing device 32 for making the transverse heat-sealed seams. For this purpose, the heat-sealing device 32 may be mounted movably along a path 33. The path 33 may extend along a longitudinal axis of the cartridge 30, that is to say it may be arranged at an angle other than 90° in relation to the longitudinal axis of the cartridge 30. The path 33 along which the heat-sealing device 32 is moved may extend parallel to the longitudinal axis of the cartridge 30.

The machine 1 may include a control computer 20. The control computer 20 is able to control automatically the heat-sealing device 32, 34, the drive 23 and further elements of the machine 1. Where the cartridge 30 is adjusted by way of an electrical drive, the control computer 20 is also able to control the electrical drive for adjusting the cartridge 30 in order to adapt the internal dimensions of the cartridge.

The pocket spring string 25 that is manufactured by the machine 1 may be processed further. Segments of a predetermined length may be severed from the pocket spring string 25 and joined together to form a pocket spring core.

Figure 2:
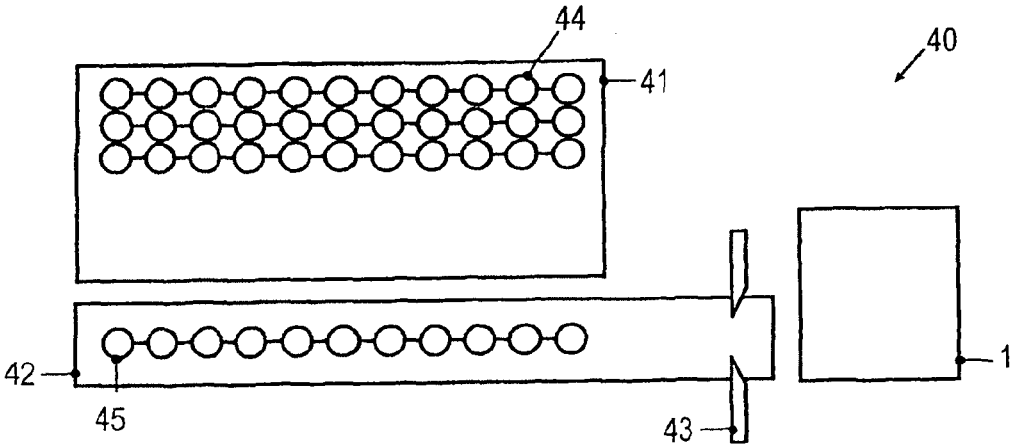
FIG. 2 is a schematic illustration of a machine for manufacturing a pocket spring core which has an apparatus for forming a tube of pocket material according to an exemplary embodiment.

FIG. 2 is a schematic plan view of a machine 40 for manufacturing a pocket spring core. The machine 40 has a machine 1 for manufacturing a pocket spring string, which may be constructed as described with reference to FIG. 1. The machine 40 has an automated mounting device 41 which combines a plurality of pocket spring strings of predetermined length to form a pocket spring core 44. The pocket spring string is transported to the automated mounting device 41 by a conveyor 42. A segment 45 of predetermined length may be severed from an endless pocket spring string using a severing device 43.

With reference to FIGS. 3-11, embodiments of apparatuses and methods by device of which a tube of pocket material is formed will be described in more detail.

Figure 3:
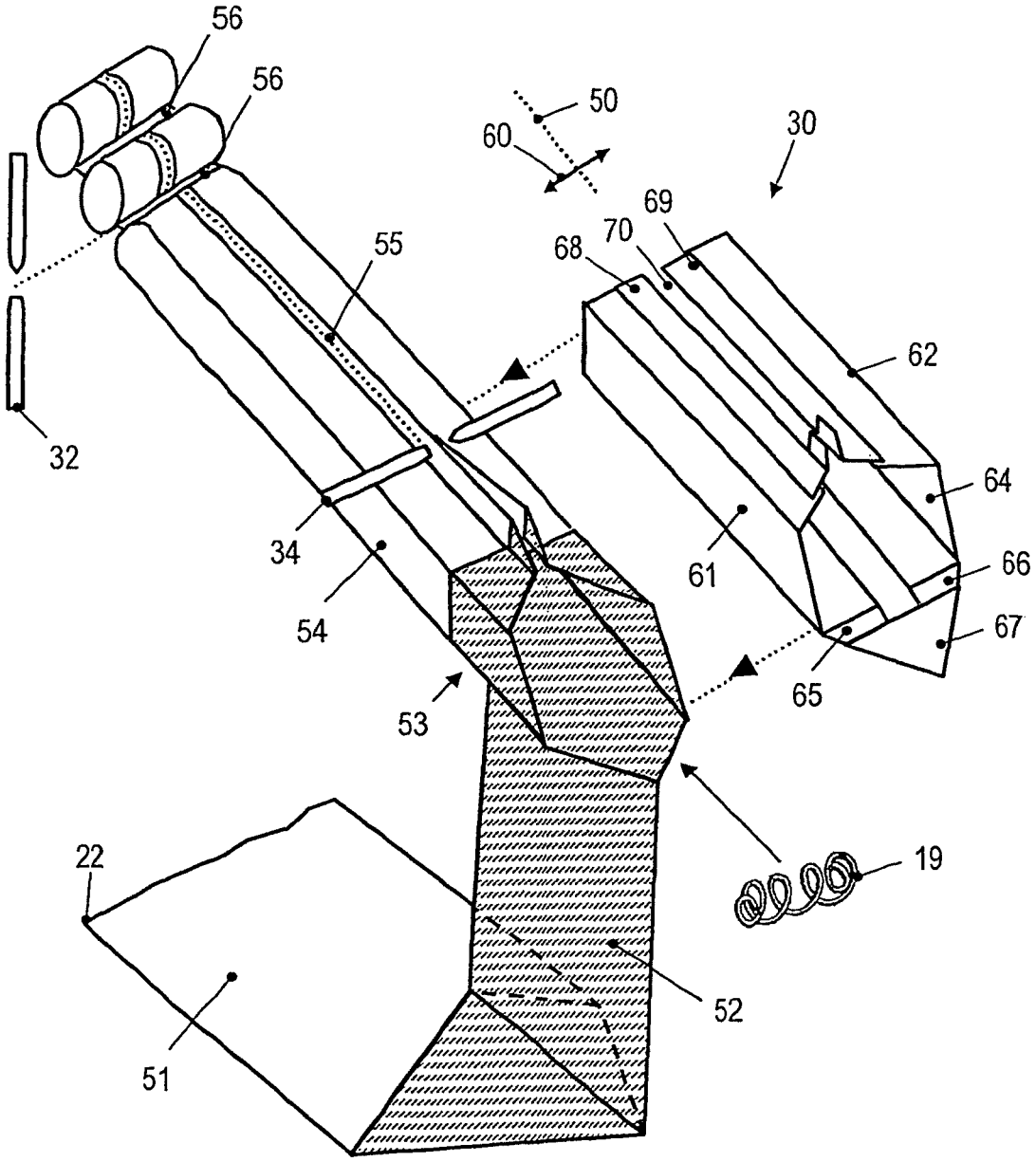
FIG. 3 is a perspective view of an apparatus for forming a tube of pocket material according to an exemplary embodiment, and a tube of pocket material that has been formed.

FIG. 3 shows a perspective view of an apparatus for forming a tube of the pocket material. Also illustrated is the pocket material, in order better to illustrate the reshaping from a web into a tube. The apparatus has a cartridge 30, which is illustrated offset from the pocket material for reasons of clarity. The apparatus has a heat-sealing device 32 for producing transverse seams between pockets, and a further heat-sealing device 34 for producing a longitudinal seam. The heat-sealing device 32 is also illustrated offset from the pocket material for reasons of clarity.

The cartridge 30 has a first element 61 and a second element 62. The first element 61 and the second element 62 may be adjusted in relation to one another by an adjustment mechanism (not illustrated in FIG. 3) in order to alter the internal dimensions of the cartridge 30. The cartridge 30 has a longitudinal axis 50. The adjustment mechanism allows the relative position between the first element 61 and the second element 62 to be altered, along a widthwise direction 60 of the cartridge 30 which is perpendicular to the longitudinal axis 50. The spacing of the two sides of the cartridge extending parallel to the longitudinal axis 50, of which the side 64 is visible in FIG. 3, may be altered by way of the adjustment mechanism.

The cartridge 30 has in its entry region, where the pocket material and springs are fed, a device for folding around the pocket material. This device for folding around the pocket material includes a first projection 65 which protrudes from the first element 61, a second projection 66 which protrudes from the second element 62, and a folding element 67 for folding the pocket material. The folding element 67 reaches at least partly around the first projection 65 and the second projection 66.

The cartridge 30 may include further elements. For example, a first covering sheet-metal part 68 and a second covering sheet-metal part 69 may be provided. The two longitudinal edges of the web of pocket material may project out of the cartridge 30 through a gap 70 between the covering sheet-metal parts. This allows a longitudinal seam to be made. A position of the first element 61 may be adjusted in relation to the first covering sheet-metal part 68 if the width of the cartridge is altered by way of the adjustment mechanism. A position of the second element 62 may be adjusted in relation to the second covering sheet-metal part 69 if the width of the cartridge is altered by way of the adjustment mechanism.

The pocket material 22 is folded in an entry region of the cartridge 30 such that a tube which is initially still open is formed. In FIG. 3, a non-hatched surface of the pocket material represents the side of the web that forms the outside of the tube. The surface that is illustrated with hatching is the side of the web that forms the inside of the tube.

The web of pocket material 22 may be pre-folded upstream of the entry region of the cartridge 30 along the centre of the web. The side 52 of the web which forms the inside of the tube can lie on the outside during this.

A section 53 of the pocket material that is arranged in the entry region of the cartridge 30 is folded around by the device for folding around and the upper edge of the cartridge 30 such that the outer surfaces of the pre-folded web that is delivered become the inside of the tube. The outer surface of the tube that is formed points towards the inner surfaces of the cartridge 30. The longitudinal edges of the web project outwards through the gap 70 to allow the longitudinal heat-sealed seam 55 to be made.

Springs 19 are also transported through the cartridge 30, where they are inserted into the tube 54. The heat-sealing device 32 forms the transverse heat-sealed seams 56 after the tube 54 of pocket material, together with the springs arranged therein, has passed an exit region of the cartridge 30.

Figure 4:
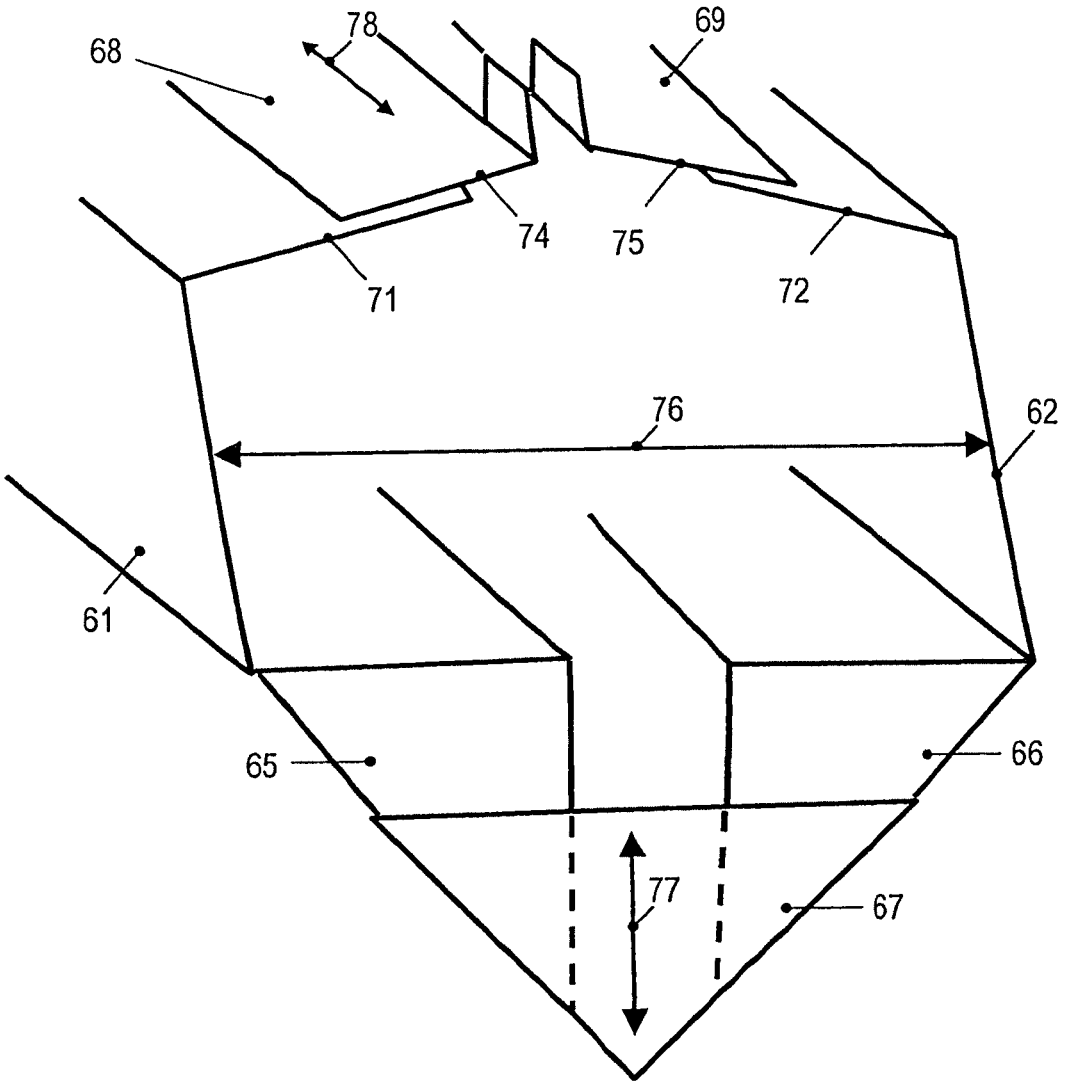
FIG. 4 is a perspective view of a detail of an entry region of a cartridge of the apparatus according to an exemplary embodiment.

FIG. 4 shows a perspective view of a detail of the entry region of the cartridge 30. A spacing 76 between the two inner sides of the cartridge, against which the pocket material is pressed by the axial ends of the springs, can be adjusted by the adjustment mechanism. The spacing 76 may be selected as a function of different parameters, in particular as a function of the height of the springs, that is to say the dimension along their axial direction, and as a function of a desired spring pretension of the springs inserted into the pockets.

The device for folding the pocket material around may be set up such that its configuration is automatically adapted in the event of an alteration in the width 76. The projections 65 and 66 may be triangular. The folding element 67 may have a base surface (pointing upwards in FIG. 4) which takes the shape of an isosceles triangle. The folding element 67 may reach partly over the projections 65 and 66. The folding element 67 may be constructed as a bent sheet-metal part, wherein the projections 65 and 66 project into the cavity formed by the folding element 67.

In order to simplify automatic adjustment of the device for folding the pocket material around to the width 76 that is set in each case, the outer edges of the projections 65 and 66 over which the pocket material is guided may extend parallel to the outer edges of the folding element 67 over which the pocket material is guided, or be arranged on a common straight line therewith. Accordingly, the inner edges of the folding element 67 at which the outer edges of the projections 65 and 66 abut against the folding element 67 may extend parallel to the outer edges of the projections 65 and 66 or be arranged on a common straight line therewith.

During operation of the apparatus for forming the tube of pocket material, the pocket material exerts a force on the folding element 67 in the direction of the elements 61, 62 of the cartridge. If the width 76 of the cartridge 30 is altered by device of the adjustment mechanism, the position of the folding element 67 in relation to the elements 61, 62 is altered accordingly. Displacement of the folding element 67 is illustrated schematically at 77. In this way, the size of a triangular surface at which the pocket material is folded around at the entry region of the cartridge may be adapted to the width of the cartridge without performing a separate adjustment of the device for folding around.

If one or more separate covering sheet-metal parts 68, 69 are present, it is possible on an upper side of the cartridge for a front edge 74 of the first covering sheet-metal part 68 to be parallel to a front edge 71 of the first element 61 of the cartridge 30 or to lie in a line therewith. A front edge 75 of the second covering sheet-metal part 69 may be parallel to a front edge 72 of the second element 62 of the cartridge 30 or lie in a line therewith. In particular, the front edges 71, 74 may lie in a line perpendicular to a plane defined by the upper side of the cartridge 30. The front edges 72, 75 may lie in a further plane perpendicular to the plane defined by the upper side of the cartridge 30.

Between the elements 61, 62 that define the side walls of the cartridge 30 and a separate element such as the covering sheet-metal parts 68, 69, there may be provided a coupling such that the relative position between the first element 61 and the covering sheet-metal part 68 and the relative position between the second element 62 and the covering sheet-metal part 69 are automatically adapted in the event of adjustment to the width of the cartridge 30. For example, the first element 61 may be coupled to the first covering sheet-metal part 68 such that adjusting the width 76 brings about a relative movement 78 between the first element 61 and the covering sheet-metal part 68, also directed at least along the longitudinal axis 50 of the cartridge 30. The coupling may be such that that adjusting the width 76 brings about the relative movement 78 along the longitudinal axis 50 of the cartridge 30 such that the front edges 71 and 74 remain arranged in a plane perpendicular to the plane defined by the upper side of the cartridge 30. Similarly, the second element 62 may be coupled to the second covering sheet-metal part 69 such that adjusting the width 76 brings about a relative movement 78 between the second element 62 and the covering sheet-metal part 69, also directed at least along the longitudinal axis 50 of the cartridge 30. The coupling may be such that adjusting the width 76 brings about a relative movement 78 along the longitudinal axis 50 of the cartridge 30 such that the front edges 72 and 75 remain arranged in a plane perpendicular to the plane defined by the upper side of the cartridge 30.

Although FIGS. 3 and 4 illustrate schematic embodiments having two covering sheet-metal parts 68, 69, it is also possible to carry out an automatic adaptation of the front edge of this kind if only one covering sheet-metal part or another separate element is provided.

In order to bring about the relative movement 78, the first element 61 may have projections extending parallel to the front edge 71. The first covering sheet-metal part 68 may have corresponding recesses that extend parallel to the front edge 74 and in which the projections of the first element 61 engage. An embodiment of this kind is described in more detail with reference to FIGS. 10 and 11. A similar coupling may be provided between the second element 62 and the second covering sheet-metal part 69.

Figure 5:
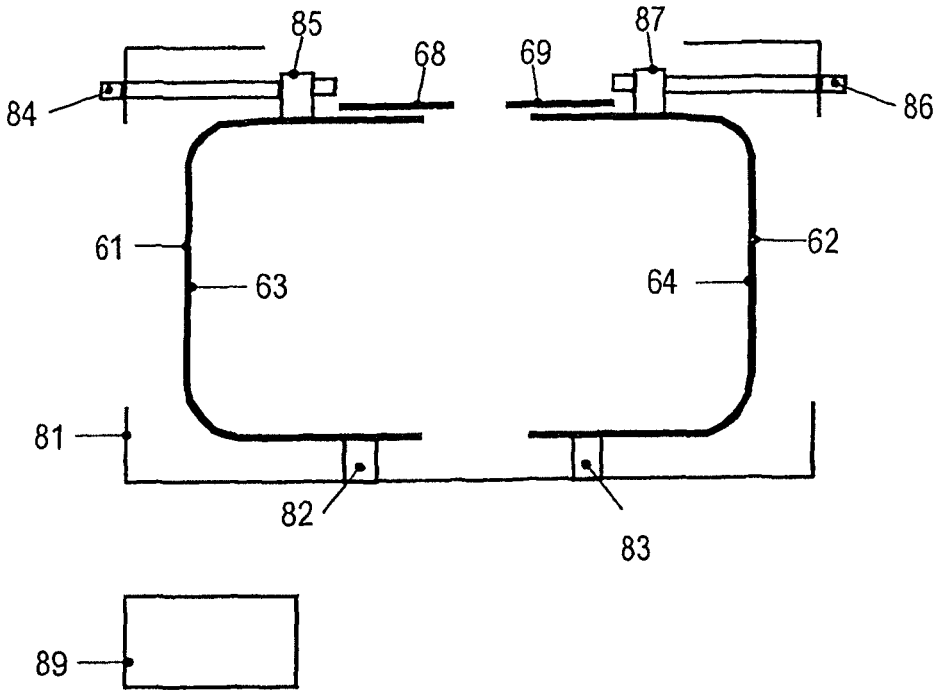
FIG. 5 is a side view of the apparatus for forming a tube of pocket material.

FIG. 5 shows a schematic cross-sectional view through the apparatus for forming the tube of pocket material. The plane of section is selected such that it extends through the adjustment mechanism.

The adjustment mechanism may have various embodiments which allow the relative position between the elements 61, 62 to be altered and hence the spacing between the inner sides 63, 64 of the cartridge 30 to be altered. The adjustment mechanism may be set up to guide movement of at least one of the elements 61, 62 in the widthwise direction 60 of the cartridge 30. The adjustment mechanism may be set up to lock the first element 61 and/or the second element 62 in order to maintain a relative position that has been set, until the adjustment mechanism is actuated again.

In the embodiment illustrated in FIG. 5, the adjustment mechanism has a first spindle drive which is coupled to the first element 61 and a second spindle drive which is coupled to the second element 62. The first spindle drive includes a spindle 84 and a spindle block 85 having a corresponding bore. The spindle block 85 is connected to the first element 61. The second spindle drive includes a spindle 86 and a spindle block 87 having a corresponding bore. The spindle block 87 is connected to the second element 62. The spindles 84, 86 may be actuated manually. As an alternative it is also possible for an actuator, for example an electric motor 89, to be provided for driving the spindles 84, 86.

An additional guide may be provided to guide movement of the first element 61 and/or the second element 62. The guide may include a guide recess and projections 82, 83 complementary therewith. The guide recess may for example be provided in a holder 81 that is arranged fixed. The projections 82, 83 may each be mounted on a respective one of the elements 61, 62.

In a further embodiment, it is also possible to provide only one spindle which is coupled to a plurality of spindle blocks 85, 86. The spindle drive formed in this way may also displace the elements 61, 62 symmetrically in relation to a centre plane of the cartridge 30.

In yet a further embodiment, an alteration in the relative position between the first element 61 and the second element 62 may be brought about by displacing only one of these elements.

Although FIG. 5 illustrates a spindle drive, a number of further mechanisms may be used to alter the internal dimensions of the cartridge 30. For example, a toothed rack drive may be used. In further embodiments, it is possible to provide a guide, to guide movement of the first element 61 and/or the second element 62. Here, the adjustment mechanism may continue to include locking, in order to lock the first element 61 and/or the second element 62. The first element 61 and/or the second element 62 may be moved along the guide manually.

With reference to FIGS. 6-9, an embodiment of the device for folding around the pocket material will be described in more detail.

Figure 6:
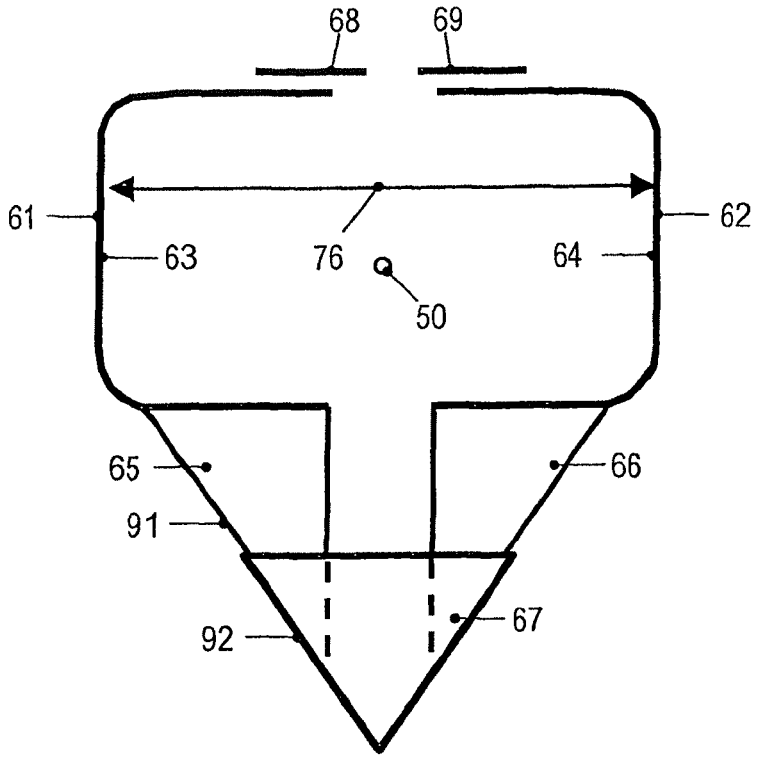
FIGS. 6 and 7 are plan views of the entry region of the apparatus for forming a tube of pocket material, for different settings of the cartridge width.
Figure 7:
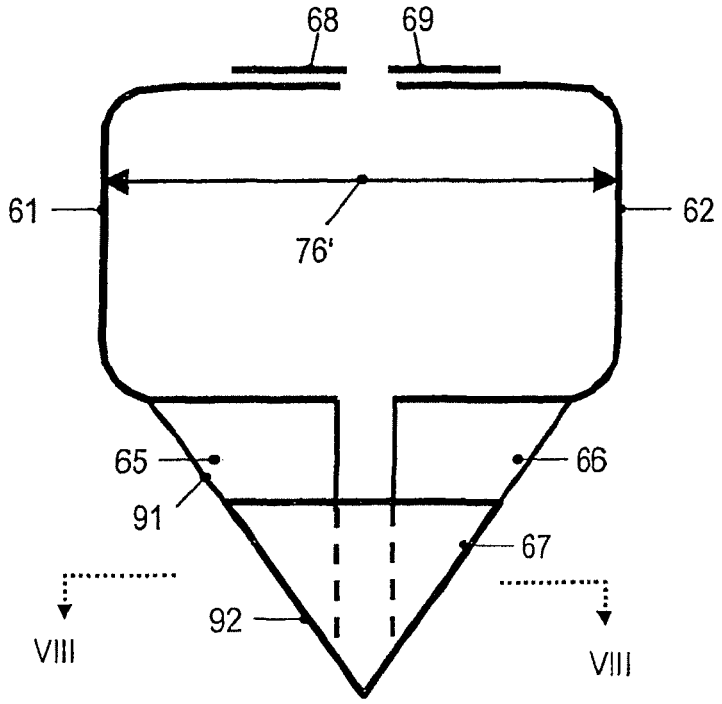

FIGS. 6 and 7 show plan views of the entry region of the cartridge 30. The direction of view is along the longitudinal axis 50 of the cartridge 30.

The projections 65 and 66 are coupled to the folding element 67. The folding element 67 is displaceable in relation to the projections 65, 66. The folding element 67 may reach at least partly around the projections 65, 66.

An edge 91 of the projection 65 is arranged parallel to or in a line with an edge 92 of the folding element 67. That is say that the direction vector of the edge 91 corresponds with the direction vector of the edge 92. Similarly, an outer edge of the projection 66 is arranged parallel to or in a line with a further outer edge of the folding element.

If the width 76 of the cartridge is reduced, the folding element 67 is displaced in relation to the projections 65, 66. When the first element 61 and the second element 62 of the cartridge are moved towards one another, then during operation of the apparatus the folding element 67 is positioned such that it is pushed further over the projections 65, 66. This is illustrated for example in FIG. 7, in which the cartridge is pushed together to give a width 76'.

As illustrated in FIGS. 5-7, the cartridge has a pair of parallel sides 63, 64 and a further pair of parallel sides that define the upper edge and the lower edge of the cavity formed by the cartridge. The cartridge may have a rectangular cross-sectional surface, wherein the transitions between the sides are advantageously rounded.

Figure 8:
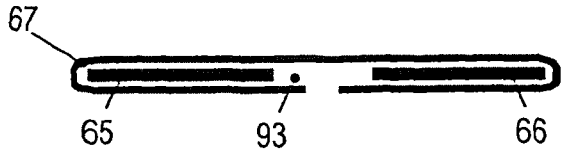
FIG. 8 is a sectional view along a line VIII-VIII in FIG. 7.

FIG. 8 is a sectional view along the line VIII-VIII in FIG. 7. The folding element 67 defines a cavity 93 into which the projections 65, 66 project. The folding element 67 may for example be shaped as a bent sheet-metal part.

Figure 9:
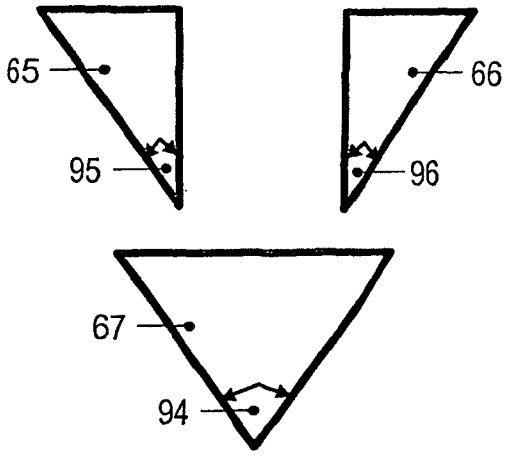
FIG. 9 is a plan view of components of the apparatus for forming a tube of pocket material.

FIG. 9 shows the projections 65, 66 and the folding element 67 in plan view. The folding element 67 may have a base surface (pointing upwards in FIGS. 3 and 4) that takes the shape of an isosceles triangle. The limb of the same length form an angle 94.

The projections 65, 66 may also be triangular. An angle of opening 95, 96 at the corner of the projections 65, 66 that the folding element 67 reaches around may be half the size of the angle of opening 94. The projections 65, 66 may take the form of right-angled triangles.

An embodiment of the device for folding the pocket material around as illustrated in FIG. 9 allows automatic adaptation down to the width 76 at which the edges of the projections 65, 66 abut against one another. In this way, adjustability over a wide range is made possible.

Figure 10:
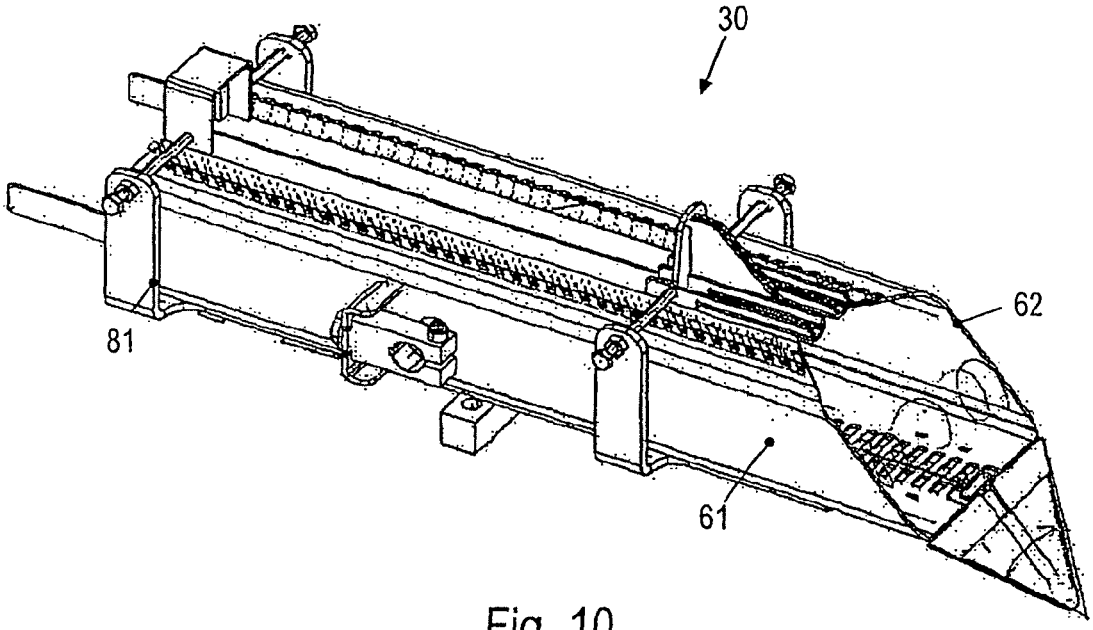
FIGS. 10 and 11 are perspective views of an apparatus for forming a tube of pocket material according to a further exemplary embodiment.
Figure 11:
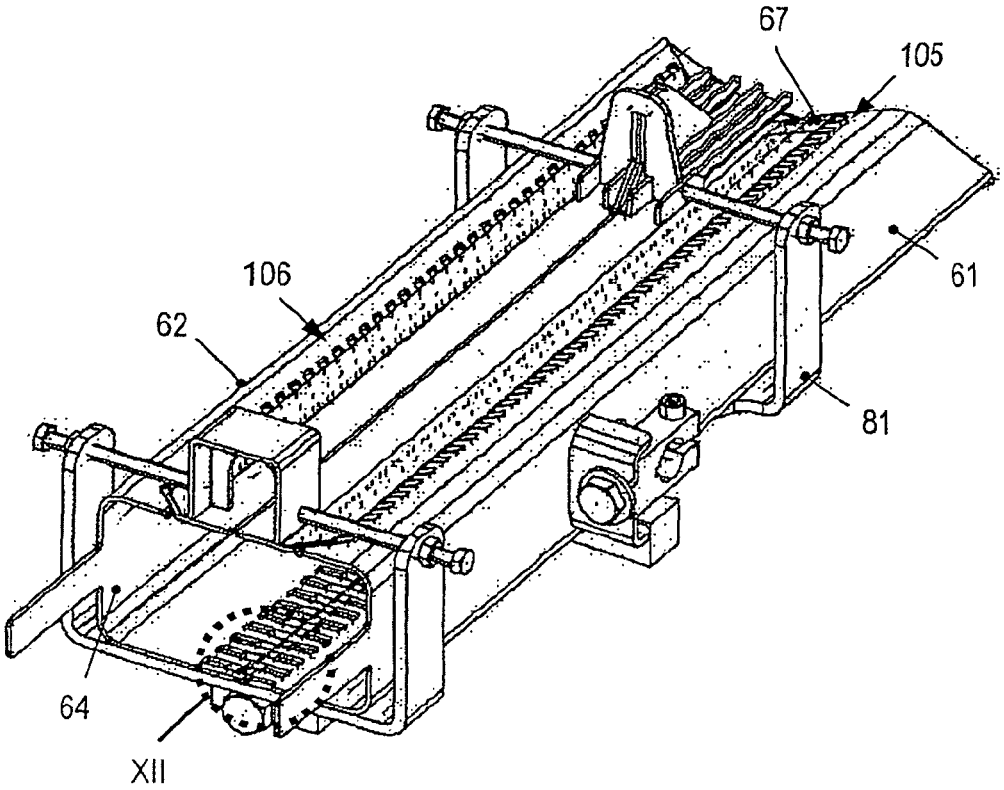

FIGS. 10 and 11 show perspective illustrations of an apparatus for forming a tube of pocket material according to a further exemplary embodiment. The general mode of functioning corresponds to the mode of functioning of the apparatus described with reference to FIGS. 3-9 for forming a tube of pocket material.

The apparatus has a cartridge 30 having a first element 61 and a second element 62. At least one of the elements 61, 62 may move in relation to a holder 81 in order to enable the width of the cartridge 30 to be set. In order to enable the relative position between the first element and the second element 62 to be altered, a corresponding adjustment mechanism is provided. The adjustment mechanism may for example include at least one spindle drive. The adjustment mechanism may be actuable manually or electronically. The adjustment mechanism may also be formed by a guide along which one of the elements 61, 62 or both elements 61, 62 may be displaced manually.

For better support of the pocket material, the first element 61 and/or the second element 62 may have a plurality of projections. The projections may project into corresponding recesses. When the width of the cartridge is altered, the projections may move further into or out of the corresponding recesses. This prevents the creation of a gap on the underside of the cartridge 30, extending over the entire length of the cartridge. This allows better support of the pocket material.

Figure 12:
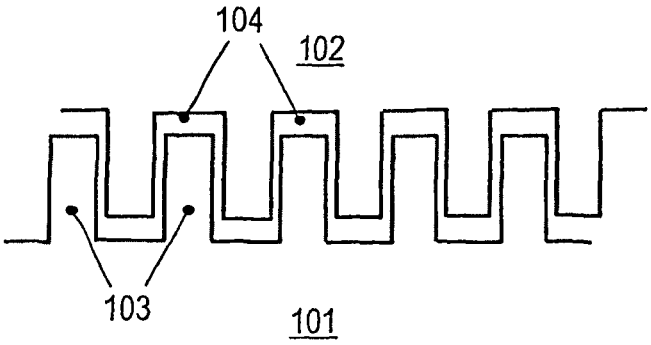
FIG. 12 shows a detail of the apparatus in FIGS. 10 and 11.

FIG. 12 shows an illustration of the detail XII from FIG. 11 on a larger scale. Finger-like projections 103 are arranged in a section 101 of the first element 61, which is arranged on the underside of the cartridge 30. Corresponding recesses 104 are arranged in a section 102 of the second element 62, which is arranged on the underside of the cartridge 30. When the width of the cartridge is adjusted, the projections 103 move out of or further into the recesses 104.

On the upper side of the cartridge too, the first element 61 and/or the second element 62 may have a plurality of projections or a plurality of recesses. For example, the first element 61 may have a plurality of finger-like projections 105 which are coupled to corresponding recesses in a separate covering element 67. Each of the projections 105 may be arranged at an angle other than 90° to the longitudinal axis of the cartridge 30. The projections 105 may in particular be parallel to a front edge of the first element 61 at the entry region of the cartridge. Similarly, the second element 62 may have a plurality of finger-like projections 106. A coupling of this kind between the first element 61 and a covering metal sheet or between the second element 62 and a covering metal sheet device that the configuration of the entry region of the cartridge may be adapted automatically to the width of the cartridge which is in each case set.

In further embodiments, other pairings of corresponding coupling elements may be used. For example, the first element 61 may have recesses on the upper side of the cartridge, in which corresponding projections of a covering element 67 engage.

Although embodiments of apparatuses for forming a tube of pocket material in which a width of a cartridge may be set have been described with reference to FIGS. 3-12, the apparatus may also be constructed such that a height may be set or such that both the width and the height of the cartridge may be set.

Figure 13:
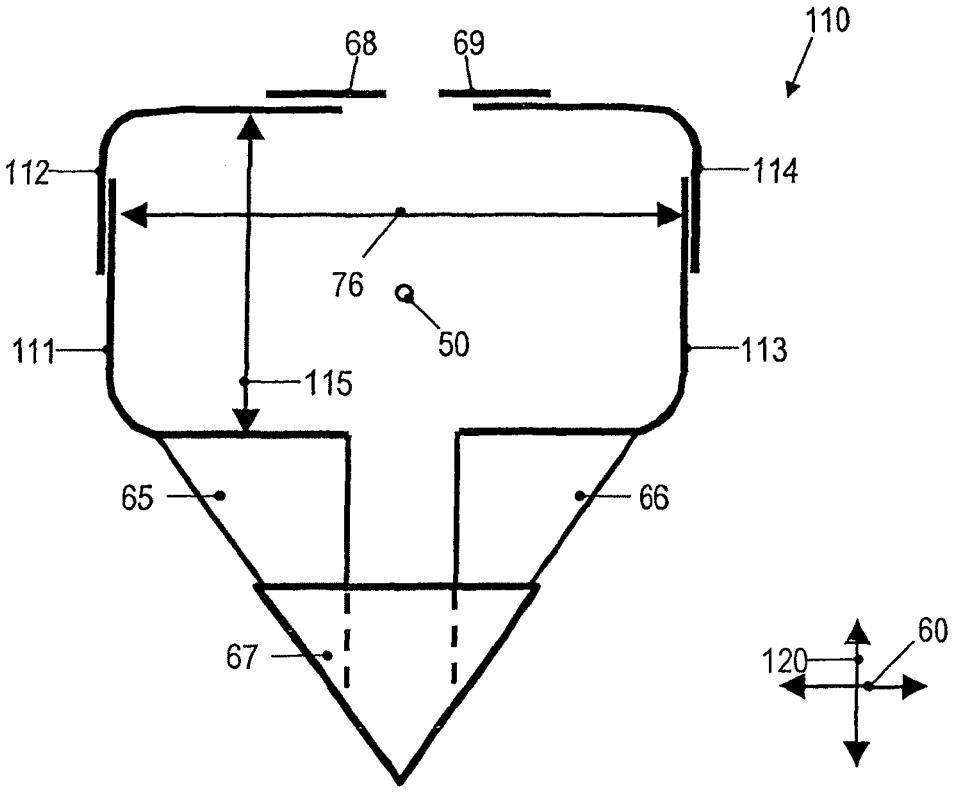
FIG. 13 is a plan view of an entry region of an apparatus for forming a tube of pocket material according to a further exemplary embodiment.

FIG. 13 shows a plan view of an apparatus for forming a tube of pocket material according to a further exemplary embodiment. The apparatus includes a cartridge having a plurality of elements and an adjustment mechanism which allows the width 76 and a height 115 of the cartridge to be set. Optionally, a device for folding the pocket material around may also be provided, as was described in detail with reference to FIGS. 3-9.

The cartridge has a first pair of elements 111, 112. The pair of elements 111, 112 defines a side surface of the cartridge. The element 112 is adjustable in relation to the element 111 in a direction 120 perpendicular to the longitudinal axis 50 of the cartridge and the widthwise direction 60.

The cartridge has a second pair of elements 113, 114. The pair of elements 113, 114 defines a further side surface of the cartridge. The element 114 is adjustable in relation to the element 113 in the direction 120 perpendicular to the longitudinal axis 50 of the cartridge and the widthwise direction 60.

The adjustment mechanism is set up to allow the relative position of the first pair having the elements 111, 112 to be altered in relation to the second pair having the elements 113, 114 in order to adjust the width 76 of the cartridge. This makes it possible to adapt to different spring heights and/or spring pretensions and/or widths of the web of pocket material.

The adjustment mechanism is set up to allow a relative position of the element 112 in relation to the element 111 of the first pair to be altered and to allow a relative position of the element 114 in relation to the element 113 of the second pair to be altered. In this way it is possible to adjust the height 115 of the cartridge. This makes it possible to adapt to different spring diameters and/or widths of the web of pocket material.

It is possible to provide a plurality of drives, for example a plurality of spindle drives, toothed rack drives or the like, in order to allow adjustment of the internal dimensions of the cartridge in a plurality of directions at right angles.

Further embodiments of apparatuses for forming a tube of pocket material or methods for manufacturing a pocket spring string may be created. For example, an adjustable cartridge may have a number of embodiments. An adjustable cartridge may also be used if the web of pocket material is not delivered to the cartridge pre-folded. An adjustable cartridge may also be used without a separate device for folding the web around.

Figure 14:
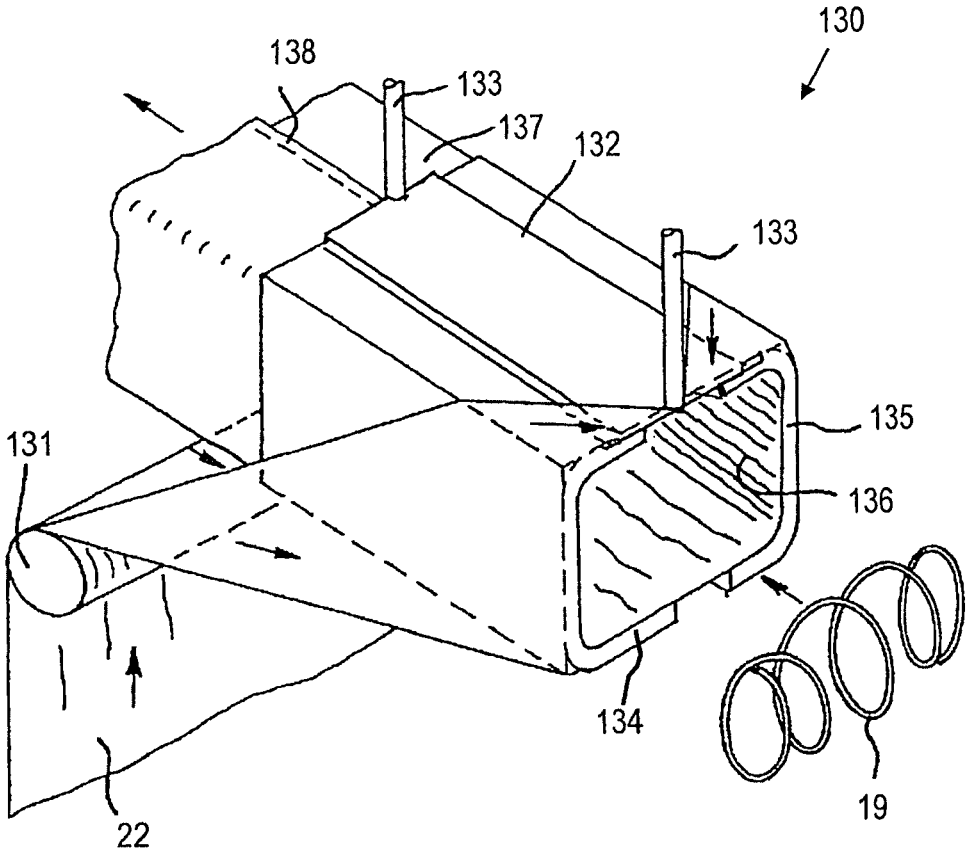
FIG. 14 is a perspective view of an apparatus for forming a tube of pocket material according to a further exemplary embodiment.

FIG. 14 is a perspective view of an apparatus 130 for forming a tube of pocket material according to a further exemplary embodiment.

The apparatus 130 includes a cartridge having a first element 134 and a second element 135 which are mounted on a support element 132. The support element 132 is held by a carrier 133.

The first element 134 and the second element 135 are mounted on the support element 132 such that their relative position perpendicular to a longitudinal axis of the cartridge can be adjusted. For this purpose, an adjustment mechanism is provided which includes for example suitable guides on the support element and the elements 134, 135. The adjustment mechanism may include a drive for moving one or both elements 134, 135.

In the case of the apparatus 130, no separate device for folding the pocket material around is provided. The pocket material is folded around at the entry end of the cartridge. For this purpose, the delivered web 22 is first guided over a deflection roller 131 to an outside of the cartridge. The web of pocket material is then drawn into the cartridge. The web in the interior of the cartridge forms a tube 136 which is initially still open. The longitudinal edges of the web 136 may be laid over one another in the cartridge to make it easier to make a longitudinal heat-sealed line.

The cartridge outputs a tube 137 of pocket material which has a rectangular cross-section with rounded corners. A longitudinal seam 138 may be made by heat-sealing the pocket material.

Springs 19 are also guided through the cartridge and there inserted into the web that has been folded into a tube 136.

Although exemplary embodiments of the invention have been described in detail with reference to the figures, numerous variants and modifications may be created as further exemplary embodiments.

For example, the apparatus for forming the tube may be constructed such that adaptation to different spring diameters is carried out by adjusting the at least one first element and the at least one second element.

The apparatus for forming the tube of pocket material may be used not only when the tube abuts against the inner sides of the cartridge but also if the web is folded around an outside of the cartridge to form the tube.

Although the apparatus for forming a tube may be used as a component of an automated machine that produces a pocket spring string comprising spring wire and pocket material, the apparatus for forming the tube may also be used in a separate machine for inserting springs into pockets. For example, springs in their finished form may be fed to this machine and then inserted into the tube that is formed and heat-sealed into individual pockets.

The apparatus for forming the tube may be constructed such that adaptation to different spring heights, spring pretensions, spring diameters or widths of the web of pocket material may be carried out. As an alternative or in addition, the cartridge may also be adjusted as a function of which type of spring is to be inserted into the pockets. For example, a dimension of the cartridge may be set as a function of whether cylindrical springs or barrel springs are to be inserted into pockets.

The apparatuses and methods according to exemplary embodiments may be used in automated device for manufacturing pocket spring strings or pocket spring cores, without being restricted to this use.

The invention claimed is:

1. An apparatus for forming a tube of pocket material for manufacturing a pocket spring string, including:

a cartridge for guiding the pocket material, which includes at least one first element and at least one second element, wherein the cartridge has an axis, a first side defined by the at least one first element and a second side defined by the at least one second element, wherein the first side and the second side are arranged spaced from one another;

a device for turning around the pocket material, which is arranged at an end of the cartridge, wherein the device includes:

at least one projection, which protrudes from the at least one first element or the at least one second element, and a folding element coupled to the at least one projection; and an adjustment mechanism which is coupled to the cartridge and configured to alter a relative position between the at least one first element and the at least one second element in a direction perpendicular to the axis, in order to adjust a spacing between the first side and the second side, wherein the folding element is configured to move toward or away from the axis when the adjustment mechanism adjusts the spacing between the first side and the second side.

2. An apparatus according to claim 1, wherein the folding element has a cavity into which the at least one projection projects.

3. An apparatus according to claim 2, wherein an edge of the at least one projection and an edge of the folding element extend along a line or parallel to one another.

4. An apparatus according to claim 2, wherein a cross-sectional surface of the cavity of the folding element takes the form of an isosceles triangle.

5. An apparatus according to claim 1, wherein the at least one first element has a plurality of projections which project into a plurality of corresponding recesses.

6. An apparatus according to claim 1, wherein the cartridge includes at least one third element lying in a plane perpendicular to the first side and the second side, and which at least partly covers the at least one first element and the at least one second element.

7. An apparatus according to claim 1, wherein the cartridge has a rectangular cross section.

8. An apparatus according to claim 1, wherein the at least one first element includes a first pair of elements whereof the relative position is adjustable in a further direction perpendicular to the axis, wherein the further direction is perpendicular to the axis and to the direction, and wherein the at least one second element includes a second pair of elements whereof the relative position is adjustable in the further direction perpendicular to the axis.

9. An apparatus according to claim 1, further including:

a heat-sealing device for making a heat-sealed seam that extends perpendicular to the axis, wherein the heat-sealing device is mounted such that it is movable relative to the cartridge along a path of motion extending along the axis.

10. An apparatus according to claim 1, further including:

a feed device for feeding the pocket material, which includes a drive device for driving a roll of the pocket material.

11. A machine for manufacturing a pocket spring string, including:

an apparatus according to claim 1; and a device for transferring springs to a cavity defined by the cartridge.

12. A method for manufacturing a pocket spring string, wherein, using a cartridge which includes at least one first element and at least one second element and a device for turning around the pocket material, which is arranged at an end of the cartridge, wherein the device includes at least one projection, which protrudes from the at least one first element or the at least one second element, and a folding element coupled to the at least one projection, a tube of pocket material, into which springs are inserted, is formed, wherein a relative position between the at least one first element and the at least one second element is set in a direction perpendicular to an axis of the cartridge and a relative position between the folding element and the axis is set in order to set an internal dimension of the cartridge.

13. A method according to claim 12, wherein the relative position is set as a function of a height of the springs or as a function of a pretension of the springs.

14. A method according to claim 12, wherein the relative position is set as a function of a width of a web of the pocket material.

15. A method according to claim 12, which is carried out using the apparatus according to claim 1.

* * * * *